United States Patent [19]

Suzuki

[11] Patent Number: 4,799,082

[45] Date of Patent: Jan. 17, 1989

[54] ELECTROSTATIC REPRODUCING APPARATUS

[76] Inventor: Keiichiro Suzuki, 2469, Nagatsuta-Cho, Midori-Ku, Yokohama-Shi, Kanagawa, Japan

[21] Appl. No.: 28,016

[22] Filed: Mar. 18, 1987

Related U.S. Application Data

[63] Continuation of Ser. No. 696,319, Jan. 30, 1985, abandoned.

[30] Foreign Application Priority Data

| | | | |
|---|---|---|---|
| Feb. 2, 1984 | [JP] | Japan | 59-15998 |
| Jun. 29, 1984 | [JP] | Japan | 59-134505 |
| Jun. 29, 1984 | [JP] | Japan | 59-134507 |
| Nov. 22, 1984 | [JP] | Japan | 59-247372 |

[51] Int. Cl.[4] ..... G03G 15/00

[52] U.S. Cl. ..... 355/14 R; 355/4; 355/14 D

[58] Field of Search ..... 355/3 DD, 4, 14 D, 14 R; 118/665, 690, 691

[56] References Cited

U.S. PATENT DOCUMENTS

| | | | |
|---|---|---|---|
| 3,765,654 | 10/1973 | Rarey et al. | 118/691 X |
| 3,936,176 | 2/1976 | Whited | 355/4 |
| 3,936,182 | 2/1976 | Sheikh | 355/4 X |
| 4,111,151 | 9/1978 | Ruckdeschel | 355/3 DD X |
| 4,113,371 | 9/1978 | Fraser et al. | 355/14 R X |
| 4,279,498 | 7/1981 | Eda et al. | 355/14 D |
| 4,313,671 | 2/1982 | Kuru | 355/14 D |

*Primary Examiner*—Arthur T. Grimley
*Assistant Examiner*—J. Pendegrass
*Attorney, Agent, or Firm*—Jordan B. Bierman

[57] ABSTRACT

An electrostatic reproducing apparatus wherein a color picture image is formed on an image retainer with a color toner, and which has detector means which applies light from a light source to both the image retainer and the color picture image and detects the light reflected thereby. The light source is employed which emits light that does not include a high spectral reflectance region for the toner employed to form the picture image. The color picture image is constituted by a plurality of color picture images of different colors.

17 Claims, 5 Drawing Sheets

ELECTROSTATIC REPRODUCING APPARATUS

This application is a continuation of application Ser. No. 696,319, now abandoned filed Jan. 30, 1985; which claims the priorities of Japanese Applications Nos. 15,998/84, filed Feb. 2, 1984; 134,505/84 and 134,507/84, both filed June 29, 1984; and 247,372/84, filed Nov. 22, 1984.

BACKGROUND OF THE INVENTION

1. Field of the Invention

The present invention relates to an electrostatic reproducing apparatus and, more particularly, to an electrostatic reproducing apparatus in which a plurality of color toners are employed to develop an electrostatic image on the surface of an image retainer. The invention also pertains to an electrostatic reproducing apparatus in which the image of a document is formed on the surface of a photosensitive member as an electrostatic latent image which is then developed by a developer and is transferred and fixed to transfer paper and, more particularly, to an electrostatic reproducing apparatus including an improved jamming sensor which detects any transfer paper which does not separate from the surface of the photosensitive member, the transfer paper having the developer image transferred thereto.

Further, the invention is concerned with an electrostatic reproducing apparatus which is arranged such that the supply of the developer or, other electrostatic reproducing process, for example, charging, exposing process is controlled in accordance with a judgement as to whether it is necessary to supply developer by detecting the density of the developer image (color toner image) formed on the surface of the photosensitive member.

2. Description of the Prior Art

Examples of conventionally known electrostatic reproducing apparatus of the type described above include a color picture image reproducing apparatus and a reproducing apparatus which is capable of reproduction with red or black toner.

As a means for detecting whether transfer paper having a toner image transferred thereto from the surface of an image retainer has been separated from the image retainer, a jamming sensing means has heretofore been known in which light is applied by a light-emitting element to the surface of the image retainer at a position where the separation of the transfer paper should have been completed, and the amount of light reflected thereby is detected by means of a light-receiving element, and, when the amount of the reflected light is relatively great, it is judged that the transfer paper has not been separated from the image retainer.

If such a jamming sensing means is applied to the electrostatic reproducing apparatus of the type described above, problems may arise. The amount of reflected light varies with the toner color; therefore, if a certain color toner is employed and the amount of reflected light is relatively great, it may be judged that the transfer paper has not been separated when in fact it has. Such misjudgement can be prevented by varying irradiation light and the light-receiving element with the toner color, but this makes the device more complex.

When a color toner is employed as a developer in an electrophotographic copying apparatus, a jamming sensor may deliver a detection output according to its spectral sensitivity when the amount of the light reflected from the developer remaining on the surface of a photosensitive drum is relatively great. This output is similar to that which is generated when the transfer paper has become undesirably wound on the surface of the photosensitive drum. In this case, transfer paper jamming cannot be accurately detected.

Such erroneous detection can be prevented by employing an arrangement in which the spectral sensitivity of the jamming sensor can be selected to match the toner. Then, however, the jamming sensor must be replaced with one which matches the toner.

This sensor detects the density of a reference picture image formed on the surface of the photosensitive drum. This reference picture image is formed by leading the picture image of a density reference plate to the photosensitive drum before the optical system reaches its predetermined exposure scanning speed and developing the image with a development unit. The developer density is controlled by an electromagnetic valve which supplies developer to the development unit hopper in response to a signal output from the density sensor which represents the density of the reference picture image.

This is known as the developer density control system by the picture image density detection method. The information detected by the density sensor includes variation in sensitivity of the photosensitive drum as the photosensitive member, change in the amount of charge in the developer, and the variations in charging and exposure conditions. It is, therefore, possible to control the developer density with respect to these variations and changes, thereby maintaining stable picture image density.

However, in a copying apparatus which is capable of employing a plurality of color toners as developer. Examples of multi-color copying apparatuses include one in which a plurality of development units, each filled with developer of a different color are arranged in the direction of rotation of the photosensitive drum, and one of the development units is selectively used. In another example, a plurality of such development units can replace each other. Since color toners have different spectral reflectance, a detector circuit which receives the output of the light-receiving element in the density sensor may be driven to saturation by certain wavelengths of irradiation light. This may also occur for a certain degree of spectral sensitivity of the light-receiving element in the density sensor. This may make it impossible to detect picture image density.

Techniques have recently been developed for forming color picture images in electrophotographic copying apparatuses with color toners which develop colors such as red, blue, green and sepia.

In an electrophotographic copying apparatus, development is generally effected such that toner particles are attached to an electrostatic latent image formed on the surface of an image retainer, such as a photosensitive drum, by exposing a document to light. The amount of toner attached to the latent image in this development greatly affects picture image quality. For this reason, to obtain a clear picture image which has adequate density and excellent color, it is necessary that the amount of the toner attached to the latent image in development be accurately controlled.

In the conventional picture image formed with black toner, an area exclusively for density detection is provided on a region of the surface of the image retainer, and what is called a "solid toner image" is formed in said detection area by an ordinary process, whereupon light for detetion is applied to the solid toner image from a light-emitting element, and the light reflected from the solid toner image is received by a light-receiving means including a light-receiving element. When the quantity of received light exceeds a predetermined level, a low-density signal is generated which indicates that the picture image density is low, and the toner is supplied to the development device in response to the low-density signal, thereby controlling the picture image density.

However, when an image is formed with color toners, if the density is controlled in the same manner as with black toner, a problem arises. Since colors have different spectral reflectance values for detected light, a color toner may cause a low-density signal to be generated despite the fact that the amount of the toner attached to the latent image is sufficient. This, may cause too much toner to be supplied, resulting in a fogged, low-quality picture image. Conversely, a color toner may not cause a low-density signal to be generated despite the fact that the amount of the toner attached to the latent image is insufficient, so that no toner supply may be effected, resulting in a picture image which has a low density and inferior color. Consequently, it is difficult to form a clear picture image with adequate density with color toners.

SUMMARY OF THE INVENTION

The present invention aims at overcoming the above-described problems of the prior art. It is, accordingly, an object of the invention to provide an electrostatic reproducing apparatus which employs a plurality of color toners and in which jamming is sensed by the single irradiation light and a single light-receiving element or in which the developer image density is detected.

It is another object of the invention to provide an electrostatic reproducing apparatus which accurately detects paper jamming with any color toner which is employed as a developer.

It is still another object of the invention to provide an electrostatic reproducing apparatus which properly detects picture image density even when a plurality of color toners are employed.

It is a further object of the invention to provide a picture image forming apparatus which easily detects picture image density and stably forms a clear picture image of adequate density and excellent color during a relatively long working life of the apparatus.

To achieve these ends, in the present invention, there is provided an electrostatic reproducing apparatus which forms a color picture image and detects the light reflected from an image retained having a toner image formed thereon. The improvement characterized in that, to form the above-described reflected light, a light source is employed which emits light that does not practically include a high spectral reflectance region for the toner which forms the above-described picture image.

Further, the invention provides an electrostatic reproducing apparatus wherein the light emitted from a light-emitting element is projected on the surface of a photosensitive member, and the amount of the light reflected from the surface of the photosensitive member is detected by a light-receiving element to thereby sense any jamming of transfer paper on the surface of the photosensitive member. The improvement characterized in that the light-receiving element is adapted to be sensitive to light having a wavelength of 420 nm or less, or between 500 nm and 660 nm.

The invention provides an electrostatic reproducing apparatus wherein the light emitted from a light-emitting element is projected on a developer image formed on the surface of a photosensitive member, and the quantity of the light reflected from the developer image is detected by means of a light-receiving element to thereby control the density of a picture image. The improvement characterized in that the wavelength of the light emitted from the light-emitting element varies with the spectral reflectance of the developer.

The invention provides a picture image forming apparatus wherein the light reflected from a toner image formed on the surface of an image retainer is detected by light-receiving means, and the detected information is processed to thereby control the toner density. The improvement characterized by comprising means for adjusting the photosensitivity of the light-receiving means (or means for making corrections by varying the photosensitivity) to match the spectral reflectance of the toner. In this case, the term "toner density" means the toner content contained in a developer.

In a preferred embodiment of the present invention, light emitted from a light-emitting means is projected on a toner image formed on the surface of a photosensitive member, and the amount of light reflected from the toner image is detectd by a light-receiving means, whereupon a signal representing the amount of reflected light is processed by detecting means to thereby control the toner density. Moreover, it is possible to vary the sensitivity of the light-receiving means by adjusting the quantity of incident light by means of a filter or selectively employing a plurality of kinds of light-receiving element. Further, an arrangement may be such that the sensitivity of the light-receiving means can be varied when a development unit is loaded on the basis of information given by means of, for example, a projection, about its associated development device or toner hopper depending on the kind of toner employed, i.e., its spectral reflectance.

These and other objects, features and advantages of the present invention will become more apparent from the following description with the accompanying drawings.

DESCRIPTION OF THE PREFERRED EMBODIMENTS

Figure 1:
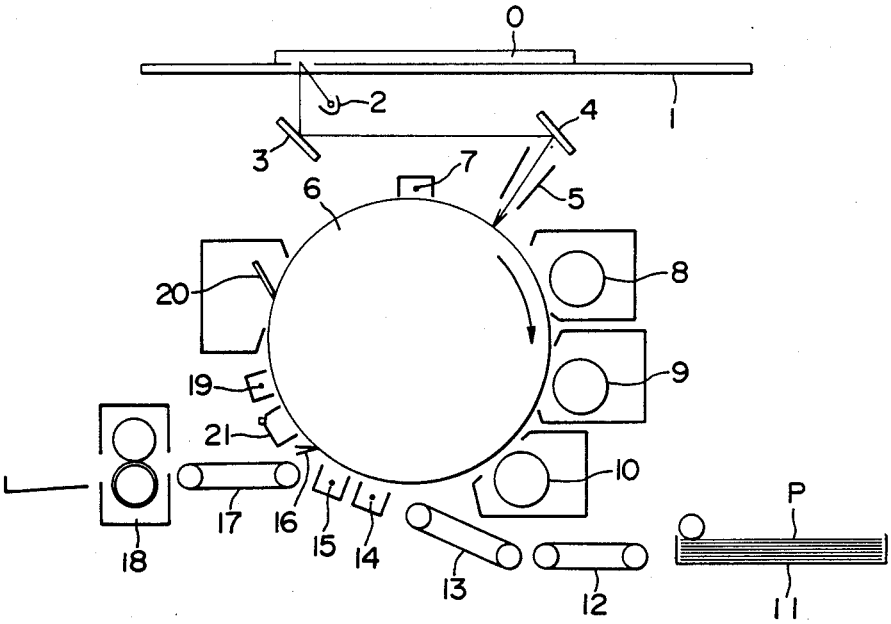
FIG. 1 schematically shows one embodiment of the electrostatic reproducing apparatus in the present invention.
Figure 2:
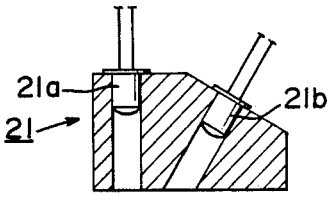
FIG. 2 is a sectional view of a device for detecting the light reflected from the surface of an image retainer.
Figure 3:
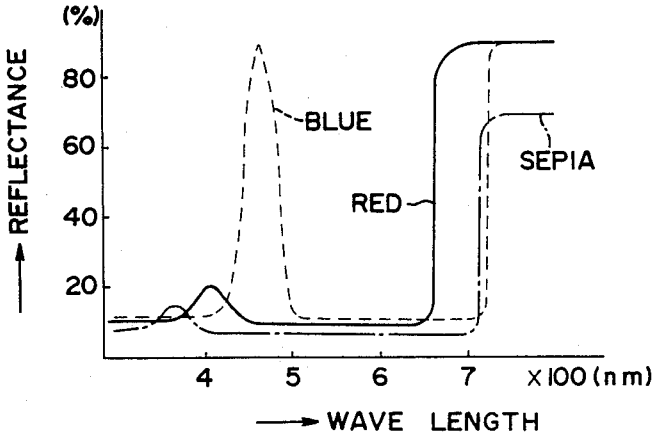
FIG. 3 is a graph showing the relationship between the wavelength of irradiation light and the reflectance of each of the color toners.
Figure 4:
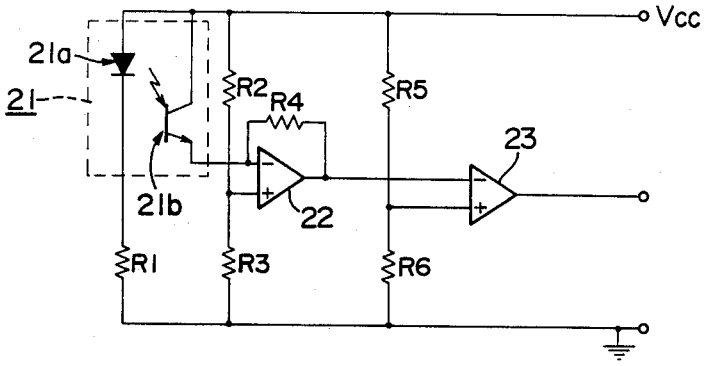
FIG. 4 is a circuit diagram of the reflected light detecting device shown in FIG. 2.

FIG. 1 schematically shows one embodiment of the electrostatic reproducing apparatus in the present invention; FIG. 2 is a sectional view of a device which detects light reflected from the surface of an image retainer; FIG. 3 is a graph showing the relationship between the wavelength of irradiation light and the reflectance of each of the color toners; and FIG. 4 is a circuit diagram of the reflected light detecting device shown in FIG. 2.

The electrostatic reproducing apparatus shown in FIG. 1 is arranged as follows. The picture image of a document 0 on a document glass plate 1 is projected by a scanning optical system onto the surface of an image retainer 6, which rotates in the direction of the arrow. Said scanning optical system includes an exposure lamp 2, mirrors 3, 4, and an exposure slit 5. Prior to the projection of the picture image of the document 0, the surface of the image retainer 6 constituted by an electrophotographic sensitive member, such as a selenium photosensitive member is uniformly charged by a charger 7. An electrostatic image is therefore formed on the surface of the image retainer 6 by the projection and is developed by any of development devices 8 to 10 which effect development with color toners such as blue, red and sepia. The developed toner image is transferred by a transfer device 14 to transfer paper P which is fed out from a transfer paper supply unit 11 by conveyors 12, 13 such that the transfer paper P contacts the surface of the image retainer 6. The transfer paper P on which the toner image has been transferred is separated from the surface of the image retainer 6 by a separation device 15 and a separation blade 16 and is placed on a conveyor 17. The transfer paper P is then fed into a fixing device 18 by the conveyor 17 where the toner image is fixed, and is discharged to the outside of the apparatus. The surface of the image retainer 6, from which the toner image has been transferred to the transfer paper P, has all charge eliminated from it by a charge eliminating device 19 and any remaining toner is cleaned from it by a cleaning device 20, thus preparing the image retainer 6 for subsequent image formation.

This reproducing apparatus is provided with a sensor 21 for detecting whether the separation of the transfer paper P has been effected without hindrance, such as that shown in FIG. 2, the sensor 21 being disposed rearwardly of the separation blade 16. The sensor 21 is arraned such that the surface of the image retainer 6 is irradiated by a light-emitting element 21a, such as an LED, and the intensity of the light reflected from the surface is detected by means of a light-receiving element 21b, such as a phototransistor. In this case, the light-emitting element 21a is adapted to emit light of a wavelength at which the reflectance of the light reflected by each of the color toners respectively employed by the development devices 8 to 10 is low, and the light-receiving element 21b is adapted to be high in its sensitivity to the light of the above-described wavelength. With this arrangement, it is possible to prevent any misjudgement of the separation of the transfer paper P which may be caused by the light reflected by the toner image, regardless of which of the development devices 8 to 10 is employed to develop the electrostatic image. Thus, the sensor 21 accurately detects the fact that the separation of the transfer paper P has not been actually effected.

This point will be explained hereinunder with reference to FIG. 3. The curves representing the reflectances of color toners which develope blue, red and sepia are shown by the dotted, solid and one-dot chain lines, respectively. Therefore, if light of a wavelength near 460 nm is employed for irradiation, there may be a misjudgement of the light reflected by the blue toner to the effect that transfer paper P has not been separated, despite the fact that separation has actually occurred. With light having a wavelength of 660 nm or more, a misjudgement may be caused by the light reflected by the red toner. Further, with light having a wavelength of 700 nm or more, a misjudgement may be caused by any of the color toners. Accordingly, when the development devices 8 to 10 respectively employ blue, red and sepia toners, it is necessary that the light-emitting element 21*a* should emit light having a wavelength of 420 nm or less, or between 500 and 660 nm, and the light-receiving element 21*b* should be highly sensitive to light emitted by the light-emitting element 21*a*.

Table 1 is the results of experiments carried out to detect jamming at different wavelengths of irradiation light with blue, red and sepia toners.

TABLE 1

| Irradiation Light Wavelength (nm) | Toner | | |
|---|---|---|---|
| | Blue | Red | Sepia |
| 400 | O | O | O |
| 460 | X | O | O |
| 565 | O | O | O |
| 700 | O | X | O |

In Table 1, the symbol O indicates that jamming was accurately detected, while the symbol X indicates that a misjudgement was made.

If light of a wavelength of 420 nm or less, or between 500 and 600 nm, irradiates the surface of the image retainer 6, jamming can be accurately detected with blue, red and sepia toners. Not that, although it is preferable for the light emitted from the light-emitting element 21*a* per se to have a wavelength in the ranges described above, light having such a wavelength may be obtained by filtering light from the emitting element 21*a* with a filter, such light having a different wavelength from the above-mentioned. From this point of view, LEDs may suitably be employed as the light-emitting element 21*a* since they emit light of various colors in accordance with their respective types and they emit light having a relatively narrow spectral width.

The sensor 21 arranged as described above is driven by a circuit such as that shown in FIG. 4. In FIG. 4: the reference numerals 21, 21*a* and 21*b* respectively denote the sensor, the light-emitting element and the light-receiving element which are the same as those shown in FIGS. 1 and 2; Vcc a power source; R1 a safety resistor for the light-emitting element 21*a*; 22 an operational amplifier; 23 a comparator; R2, R3 and R5, R6 pairs of voltage-dividing resistors employed to input preset voltages to the non-inverting input terminals of the operational amplifier 22 and the comparator 23; and R4 a feedback resistor which connects the inverting input terminal and output terminal of the operational amplifier 22. Jamming is indicated by an output signal from the comparator 23.

The present invention is not limited to the above-described embodiment. It may be applied to other types of electrostatic reproducing apparatus, for example, one in which transfer and cleaning operations are not effected at every full turn of the image retainer 6 and a color toner image is formed on the image retainer 6 by repeating the formation of an electrostatic image by successive exposures of each color and development by corresponding color toners and is then transferred to the transfer paper P. The invention may be applied to another type of electrostatic reproducing apparatus in which exposure for each of the colors is effected by dot-pattern exposure by a laser beam through an acousto-optic modulator, and a rotary polygon mirror. The invention may also be utilized to detect toner image density by disposing the sensor 21 forward of a position where the developed toner image is transferred to the transfer paper P.

The electrostatic reproducing apparatus in the present invention accurately detects whether transfer paper P has been separated from the image retainer with a single detector in a state wherein the detection is hardly affected by any of a plurality of color toners. Another form of the present invention detects the developer image density with a single detector.

Figure 5:
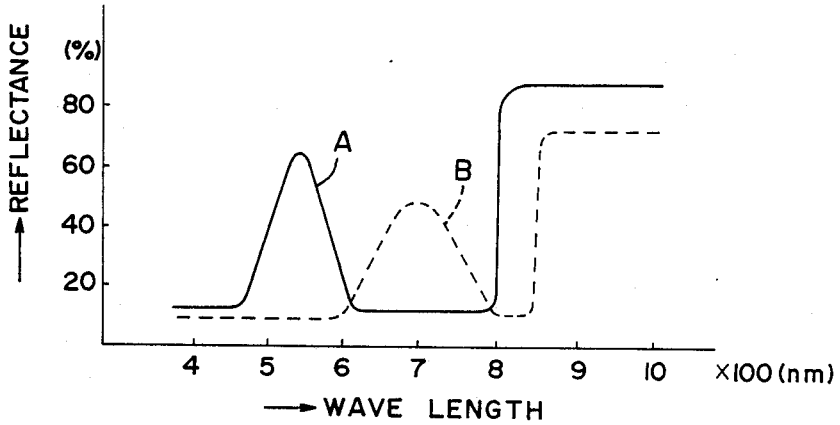
FIG. 5 is a characteristic chart showing spectral reflectances of two color toners.

The following is a description of another embodiment of the present invention. FIG. 5 is a characteristic chart of spectral reflectances of a first color toner A and a second color toner B. The Figure shows that the reflectances of both color toners A, B vary greatly with the wavelength. The reflectance of the color toner A is relatively low for an irradiation light at a wavelength between 600 and 800 nm; the reflectance of the color toner B is relatively low for irradiation light at a wavelength of 600 nm or less.

Therefore, if the developer image density is detected by irradiation with light at a wavelength at which the reflectance of either of the color toners is low, the amount of light reflected from that color toner is so small that it does not drive the light-receiving element of the density sensor 21 to saturation.

Figure 6:
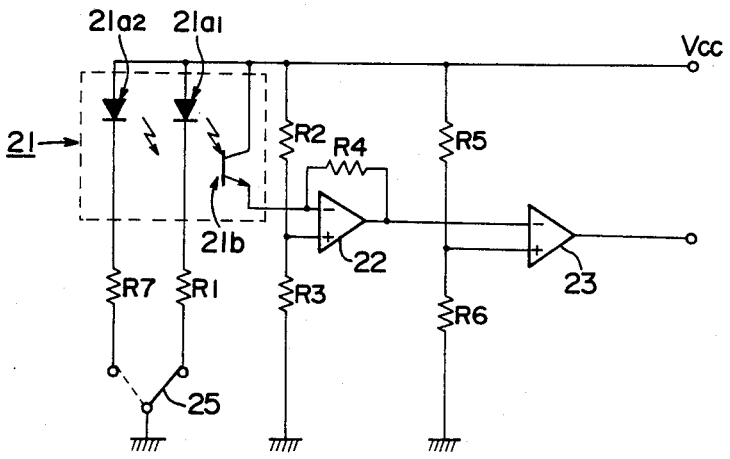
FIG. 6 is a circuit diagram of a detector circuit.

FIG. 6 shows a detector circuit for obtaining a picture image density signal by processing a detected signal from the sensor 21. LEDs 21*a*1, 21*a*2 of the density sensor 21 are connected in series in the forward direction between the power source Vcc and a selector switch 25 to the resistors R1, R7, respectively. The switch 25 is grounded. The arrangement of the other components is the same as that shown in FIG. 4.

In this detector circuit, LED 21*a*1 or 21*a*2 can be selected with switch 25. In the above-described embodiment, when color toner A is to be used, LED 21*a*1 is selected so that the peak wavelength of the irradiation light falls between 600 and 800 nm. When color toner B is to be used, the LED 21*a*2 is selected so that the peak wavelength of the irradiation light is 500 nm or less.

The phototransistor 21*b* operates in such a manner that the smaller the quantity of the reflected light incident thereon, that is, the lower the density of the developer on the photosensitive drum 6, the smaller the emitter current of the phototransistor 21*b*. The emitter current is converted into a voltage and amplified by the operational amplifier 22. The output of the amplifier 22 increases inversely with the amount of reflected light incident on the phototransistor 21*b* and is applied to the comparator 23 which constitutes a subsequent stage of the circuit. When the output of the operational amplifier 22 which is applied to the inverting input terminal of the comparator 23 exceeds a reference voltage applied to the non-inverting input terminal of the comparator 23, it delivers a low-level output voltage which indicates that the detected density of the developer image is higher than a predetermined value.

The signal representing the densith thus detected is delivered to the electromagnetic valve of the development unit so as to open or close the valve, whereby the supply of the developer from the corresponding hopper is started or suspended.

Note that the selector switch 25 can be operated automatically in response to the loading of any of the development units by providing projections on the respective development devices or the hoppers of the development units, the projections being made different from each other so as to identify their corresponding color toners, in such a manner that the projections are acutated by the loading of the corresponding development units.

Although the above-described embodiment employs two color toners, it is a matter of course that the present invention may be applied to an arrangement in which three or more color toners are employed on the basis of the same idea as that described above.

Thus, the above-described embodiment of the present invention advantageously controls the density of each of the color toners which in combination form a picture image even in an electrostatic reproducing apparatus in which a plurality of color toners are employed to allow formation of a color picture image.

Still another embodiment of the present invention will be described hereinunder.

Figure 7:
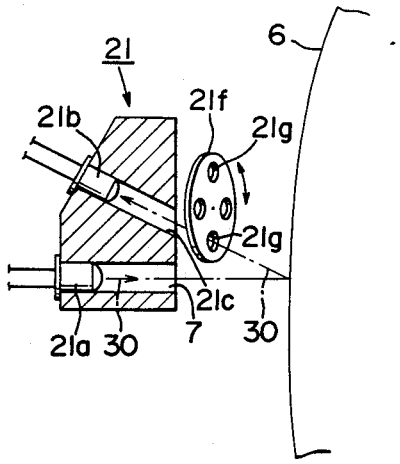
FIG. 7 is a partly-sectioned schematic view of a density sensor and means for adjusting the sensitivity thereof.

FIG. 7 is a sectional view of the density sensor 21 of this embodiment. An LED (light-emitting diode) is provided as a light-emitting element so as to extend into an optical path formed in the body of the sensor 21, while a phototransistor 21*b* is provided as a light-receiving element so as to extend into an optical path 21*c*. A density sensor 21 is arranged so that the light 30 emitted from the LED 21*a* passes through the optical path and is reflected from the surface, a reference picture image surface, of the photosensitive drum 6, then passes a filter 21*f* and enters the phototransistor 21*b* through the optical path 21*c*. The peak wavelength of the light 30 emitted from the LED 21*a* is set at 950 nm, and the phototransistor 21*b* employed is sensitive to light of this wavelength.

This density sensor 21 is arranged so that the amount of reflected light can be corrected by rotating the filter 21*f* or changing over components 21*g*, which can replace each other. The filter components 21*g* transmit different amounts of light. Therefore, the sensitivity of the density sensor 21 can be adjusted by selecting the filter components 21*g* of the filter 21*f* to match the spectral reflectance of the toner. Further, the filter 21*f* may be arranged such that the filter components 21*g* are changed automatically or manually.

Figure 8:
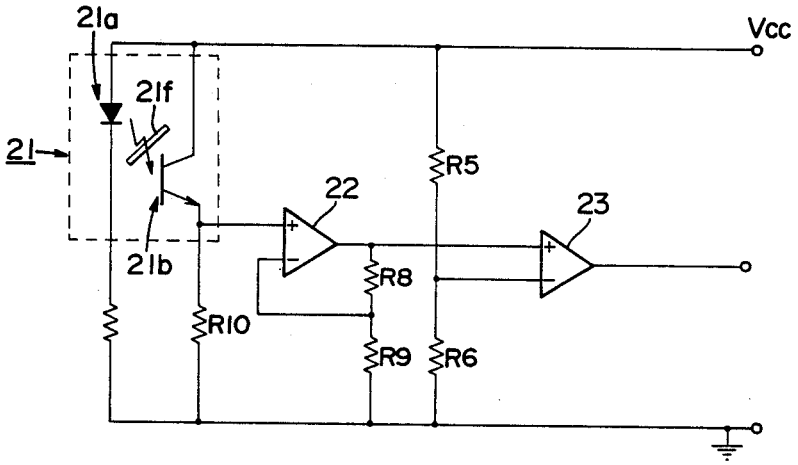
FIGS. 8 and 12 are diagrams of respective equivalent circuits of two examples of the detector circuit.

FIG. 8 shows a detector circuit for obtaining a picture image density signal by processing a detected signal from the density sensor 21. In this detector circuit, the phototransistor 21*b* in the density sensor 21 is connected between the power source Vcc and the ground through a resistor R10, and the node between the resistor R10 and the phototransistor 21*b* is connected to the non-inverting input terminal of the operational amplifier 22. The inverting input terminal of the operational amplifier 22 is connected to the output terminal thereof through a resistor R8 and is grounded through a resistor R9. The output terminal of the operational amplifier 22 is connected to the inverting input terminal of the comparator 23. To the non-inverting input terminal of the comparator 23 is applied a voltage which is obtained by dividing the supply voltage Vcc by the resistor R5 and R6, as a reference voltage for comparison.

The phototransistor 21*b* operates in such a manner that, the more reflected light incident thereon, that is, the lower the density of the toner on the photosensitive drum 6, the larger the emitter current of the phototransistor 21*b*. The emitter current is converted into a voltage and amplified by the operational amplifier 22. The output of the operational amplifier 22 increases with the amount of reflected light incident on the phototransistor 21*b* and is applied to the comparator 23 which constitutes a subsequent stage of the circuit. When the output of the operational amplifier 22 which is applied to the inverting input terminal of the comparator 23 exceeds a reference voltage being applied to the non-inverting input terminal thereof, the comparator 23 delivers a low-level output voltage which indicates that the detected toner image density is lower than a predetermined value.

The signal representing the density thus detected is delivered to the electromagnetic valve of the development unit to open or close the valve so that the supply of the toner from the hopper is started or suspended, thereby controlling toner density.

Figure 9:
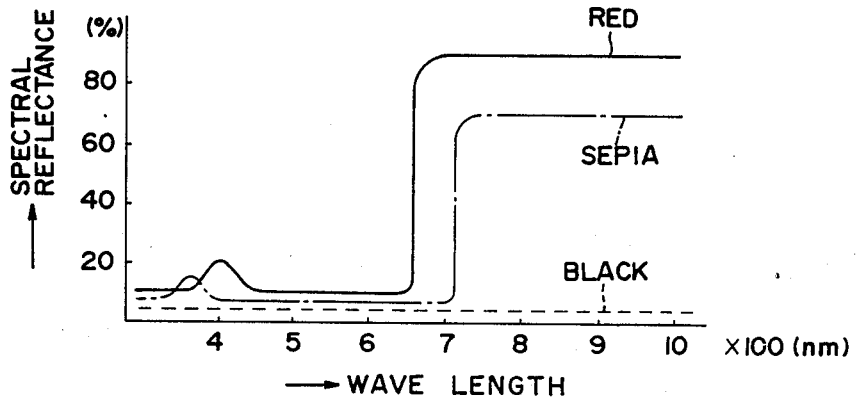
FIG. 9 is a characteristic chart which compares spectral reflectances of toners.

FIG. 9 is spectral reflectance characteristics of black, sepia and red toners, all typical color toners. At 950 nm, the difference between the spectral reflectance of black and red toners is great. Experiment has shown that when the light-receiving element is arranged so as to be sensitive to a wavelength of 950 nm, the amount of the light reflected by the red toner is three times as great as that the black toner.

Therefore, in this embodiment, the sensitivity of the light-receiving element is made to vary inversely with the spectral reflectance of the toner. For example, in a copier with black and red toners, if the density sensor 21 is arranged so that its light-receiving element is sensitive a wavelength of 950 nm as described above, the sensitivity of the light-receiving element in the detection of the density of the red toner should be set so as to be ⅓ of that in the detection of the density of the black toner.

Figure 10:
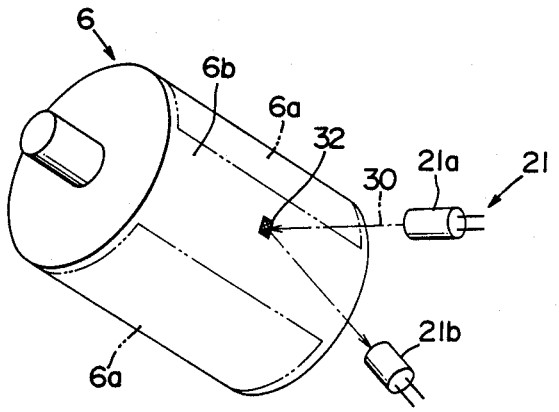
FIG. 10 is a perspective view showing how the light reflected from a toner density control picture image is received by a sensor.
Figure 11:
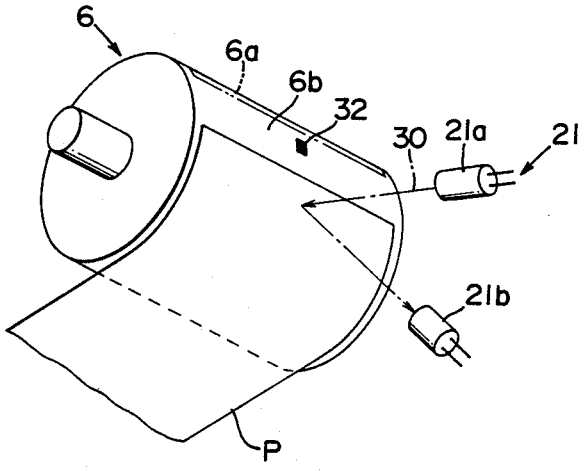
FIG. 11 is a perspective view showing how a separation failure (jamming) of transfer paper is detected by a sensor.
Figure 12:
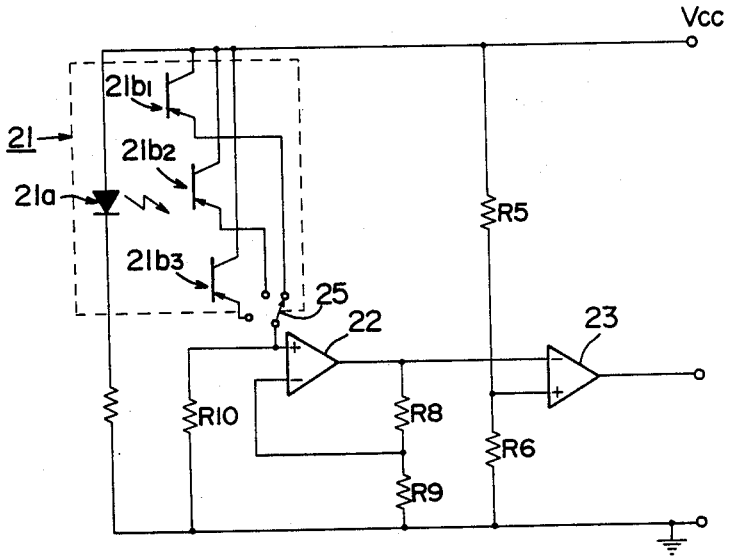

The above-described density sensor 21 may be disposed in the manner shown in FIGS. 10 and 11 (the filter 21*f* is not shown). A toner density control picture image 32, which is obtained by developing the latent image of the reference picture image formed on the photosensitive member 6 by means of the development unit, reflects the light which is applied thereto by the light-emitting element 21*a* to the light-receiving element 21*b*. Thus, transfer paper P jamming where the transfer paper P passing through the transfer section does not separate from the photosensitive member 6 but becomes wound thereon is easily detected. Note that the reference numeral 6*a* in the Figures denotes a picture image area, while the numeral 6*b* represents a non-picture image area.

FIG. 1 shows a further embodiment of the present invention.

In the detector circuit in accordance with this embodiment, density sensor 21 has a plurality (e.g., three) of kinds of phototransistor 21*b*1, 21*b*2 and 21*b*3. These phototransistors are connected between the power source Vcc and the ground through the resistor R10. The node between the resistor R10 and each of the phototransistors 21*b*1 to 21*b*3 is connected to the non-inverting input terminal of the operational amplifier 22. The phototransistors 21*b*1 to 21*b*3 are changed over from one to another by means of the switch 25, whereby they are selectively used. The phototransistors 21*b*1 to 21*b*3 are of different sensitivity. For example, when the density of the black toner is to be detected, phototransistor 21*b*1 is employed; when the density of the red toner is to be detected, phototransistor 21*b*2 is employed because its sensitivity is ⅓ that of phototransistor 21*b*1.

Each of the phototransistors 21*b*1 to 21*b*3 operates so that emitter current varies directly with the amount of reflected light incident thereon and inversely with the density of the toner on the photosensitive drum 6. The emitter current is converted into a voltage and amplified by the operational amplifier 22. The output of the operational amplifier 22 increases with the quantity of the reflected light incident on the phototransistor employed and is applied to the comparator 23 which constitutes a subsequent stage of the circuit. When the output of the operational amplifier 22 which is applied to the inverting input terminal of the comparator 23 exceeds a reference voltage being applied to the non-inverting input terminal thereof, the comparator 33 delivers a low-level output voltage which indicates that the detected toner image density is lower than a predetermined value.

Note that selector switch 25 can be operated automatically in response to the loading of any of the development units by, for example, providing on the respective development devices or hoppers of the development units, projections or bar codes which differ from each other so as to identify their corresponding color toners. Alternatively, the switch 25 may be arranged so as to be operated manually.

The above-described embodiments of the present invention may be further modified on the basis of the technical idea of the invention.

For example, the means for adjusting the photosensitivity of the light-receiving means, such as the light-receiving element, is not limited to the above-described filter 21*f* and the changeover switch 25; the structure, arrangement and operating method thereof may be variously modified. Neither is the present invention is limited to the apparatus in which three kinds of color toner are employed and may, as a matter of course, be applied to apparatuses in which two, or four or more kinds of color toner are employed. The means for forming an electrostatic latent image on the surface of the photosensitive member is not limited to the exposure unit which is employed in an ordinary electrophotographic copying apparatus; it is possible to employ a CRT or even an exposure unit and a CRT together. It is also possible to use a belt-shaped photosensitive member or a dielectric drum as the image retainer instead of the above-described drum-shaped photosensitive member.

Moreover, a picture image may be formed in the above-described apparatus in the following manner. A toner is employed which has been mixed so as to belong to any one of the following three groups; a first group consisting of red, blue, green, orange, yellow and other colors of this type which have a spectral specific reflectance of 70 to 95% with respect to any light having a wavelength of 800 nm or more; a second group consisting of this type which have a spectral specific reflectance f 20 to 60% with respect to the above-described light; and a third group consisting of black and other colors of this type which have a spectral specific reflectance of 10% or less with respect to the above-described light. In this case, a picture image is formed while light having a wavelength of 800 nm or more which is applied to and reflected by the image retainer is being detected. In such a case, in the formation of a picture image, it is possible to detect whether the correct amount of toner has been attached to the toner image to match the color type of the toner employed for development. This detection is based on a set light quantity value corresponding to the group to which the toner belongs with light for detection having the same wavelength, i.e., 800 nm or more. Consequently, toner is optimally supplied at all times regardless of the toner color. Also, it is necessary only to adjust the sensitivity of the light-receiving element to correspond to the above-described three groups, so that the sensitivity adjustment is made simple.

As has been described above, according to the present invention, the photosensitivity of the light-receiving means is adjusted to match the spectral reflectance of the toner. Therefore, for any color toner, density detection is stable and accurate at all times due to the sensitivity adjustment of the light-receiving means. The result is a clear picture image which has adequate density and excellent color.

Note that the following arrangement may be employed for a picture image reproducing apparatus in which the density of the toner image which has been made visible by the development of the toner is detected by a reflex-type photosensor, and the toner supply and the toner bias voltage are controlled on the basis of the detected information, whereby the toner density is controlled so as to be properly corrected. When a copy of each of the colors is to be made by development units replacing each other in the above-described apparatus, information about each color is recorded on each of the detachable development units, and when any of the colors is to be used, information about that color is sent to the picture image reproducing apparatus, whereby conditions for controlling toner supply the toner bias voltage which are correct for the color employed are automatically set by the switching operation of an electronic circuit, thereby reproducing an excellent picture image with respect to each of the colors at all times.

Density may be deliberately varied with the following arrangement. The above-described control is effected by converting the signal representing the reflection density detected as described above into a digital value, and storing in a digital memory conditions so that an optimal picture image density is obtained with respect to each of the colors, then making a digital comparison between the contents of the digital memory and the A/D converted signal, the digital memory being arranged such that the contents thereof can be varied, as desired, from the control unit.

Spectral reflectance is different for black, sepia and red toners, all typical toners. For light having a wavelength of 950 nm, for example, spectral reflectance for black and red toners is very different. Experiments have shown that red toner reflects three times as much light as black when the detector is set for 950 nm.

When the detector gain is set for black toner, the output value of the detector may reach saturation if the detector attempts to read the density of red toner. The intense light reflected by red toner drives the detector output to saturation, making it impossible to accurately detect the density of red toner.

Therefore, the detector circuit is arranged so that its gain varies inversely with the spectral reflectance of the toner. When the density sensor 21 is set to 950 nm as described above in a copying apparatus in which black and red toners are employed, the gain for the red toner should be set to ⅓ of that for the black toner.

The toner supply, the development bias or the exposure amount is controlled to obtain an excellent picture image at all times regardless of the colors employed.

In the present invention, detachable development units are employed, and, to effect color reproduction by units replacing each other, color identification information has been recorded in advance on each of the development units, and the conditions set in the control unit are changed by detecting the recorded information. Means for being identified which respectively represent the toners contained in the development units may be formed by respectively providing the units with projections, recesses or symbols which indicate reflectance, parts which have different conductance, or magnetic plates. The electrostatic reproducing apparatus is provided with identifying means, such as photocouplers, microswitches, electric conduction elements or magnetic sensors at positions corresponding to the means for being identified. The number of each of the identifying means is equal to that of the means for being identified. The means are identified mechanicall, optically, electrically or magnetically to obtain color information.

Figure 13:
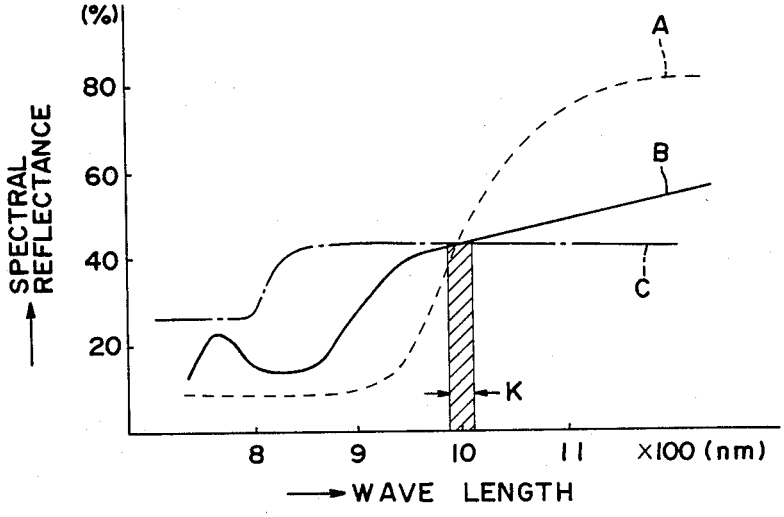
FIG. 13 is a characteristic chart showing spectral reflectances of three color toners in another embodiment of the present invention.

As shown in FIG. 13, as color toners (A, B, C), are employed which are of substantially equal spectral reflectance within a certain wavelength range K.

Irradiation light with a wavelength range in the above-described range K is employed, and a sensor is employed having a range of wavelengths to be detected which include the wavelength range K. Alternatively, irradiation light is employed having a wavelength range which includes the above-described wavelength range K, and a sensor is employed having a range of wavelengths to be detected which is included in the wavelength range K.

The toner of blue, red or sepia used in the above embodiments is varied a little in spectral reflectance according to the kind of pigment and the mixing ratio, but it does not affect on the present invention essentially and the present invention is effective to the electrostatic reproducing apparatus using toner of each color.

What is claimed is:

1. In an electrostatic reproducing apparatus in which a plurality of color toners are employed and which comprises means for detecting paper jamming on an image retainer, said detecting means comprising a light source directing a light onto said image retainer and a light receiving means, the improvement characterized in that said light source emits a light which does not contain a substantial spectral component having a high reflectance for any of said color toners.

2. An electrostatic reproducing apparatus according to claim 1, wherein said light source employed emits only light having a wavelength of 420 nm or less, or between 500 nm and 660 nm.

3. An electrostatic reproducing apparatus according to claim 1, wherein the wavelength of the light emitted from said light-emitting element varies in response to a development unit charged with said toner.

4. The apparatus of claim 1 having a plurality of developing devices each of which contains a toner of a different color.

5. The apparatus of claim 1 having a developing device exchangeable for another developing device, each said device containing a different color.

6. The device of claim 1 wherein said detecing means has a sensitivity only to light of 420 nm or less, or between 500 nm and 660 nm.

7. In an electrostatic reproducing apparatus having a light emitting element projecting light onto a plurality of toner images of different colors on the surface of a photosensitive member, a detecting means for detecting the quantity of light reflected from each toner image to provide detected information, and means for controlling the density of a picture image based on said reflected light, the improvement comprising each of said toners having a spectral reflectance substantially equal to a light of a predetermined wavelength region, a wavelength region of detected light formed by a combination of a wavelength region of said projected light and a wavelength region of said reflected light is included in said predetermined region.

8. In an electrostatic reproducing apparatus having a light-emitting element which projects light onto the surface of a photosensitive member and a detecting means for determining the quantity of light reflected from said surface, whereby said detecting means is capable of detecting the presence of transfer paper on said surface due to failure of said paper to separate from said surface, the improvement which comprises said detecting means being sensitive only to light of 420 nm or less, or between 500 to 660 nm.

9. In an electrostatic reproducing apparatus having a light-emitting element which projects lights onto a toner image on the surfacce of a photosensitive member and a detecting means for determining the quantity of light reflected from said toner image, whereby the density of a picture image is controlled by said quantity, the improvement which comprises means for varying the wavelength of the light emitted by said element or the sensitivity of said detector whereby the wavelength of said emitted light varies with the spectral reflectance of said toner in response to loading into said apparatus a development unit having a predetermined color toner.

10. In an electrostatic reproducing apparatus having a light emitting element which projects emitted light onto a toner image on the surface of a photosensitive member and a detecting means for determining the quantity of light reflected from said toner image, whereby the density of said toner image is controlled by said quantity, the improvement which comprises means for varying the wavelength of said emitted light so that said emitted light has a low reflectance for said toner image.

11. In the apparatus of claim 10, the improvement comprising a plurality of light emitting elements having different spectral characteristics selectively placed in operating position based on the spectral reflectance of said toner image.

12. In a picture image forming apparatus having a detecting means for detecting light reflected from a toner image on an image retainer to provide detected information and a means for controlling toner density based on said information, the improvement comprising color neutral filter means for substantially varying the sensitivity of said detecting means based on the spectral reflectance of said toner image.

13. In a picture image forming apparatus having a detecting means for detecting light reflected from a toner image on an image retainer to provide detected information and a means for controlling toner density based on said information, the improvement comprising color neutral filter means for substantially varying the sensitivity of said detection based on the spectral reflections of said toner image, whereby said detecting means has a high sensitivity for said spectral reflectance.

14. In a picture image forming apparatus having a light emitting means projecting light onto a toner image on an image retainer, a detecting means for detecting light reflected from said toner image to provide detected information, and a means for controlling toner density based on said information, the improvement comprising color neutral filter means for varying a characteristic of said detecting means based on the spectral reflectance of said toner, whereby said detecting means has a high sensitivity for said spectral reflectance.

15. An electrostatic reproducing apparatus wherein a color picture image is formed on an image retainer with a color toner and which comprises a light source for emitting light that does not substantially include a high spectral reflectance region for the toner employed to form said picture image and a light receiving means for detecting the light reflected.

16. An electrostatic reproducing apparatus according to claim 15 wherein said light source employed emits only light having a wavelength of 420 nm or less, or between 500 nm and 600 nm.

17. In a picture image forming apparatus having a light emitting means projecting light onto a toner image on an image retainer, a detecting means for detecting light reflected from said image to provide detecting information, and a means for controlling toner density based upon said information, the improvement comprising color neutral filter means for varying the intensity of the projected light emitted from said light emitting means based upon the spectral reflectance of said toner, said detecting means having a high sensitivity for said spectral reflectance

* * * * *